US006486861B1

(12) United States Patent
Preas et al.

(10) Patent No.: US 6,486,861 B1
(45) Date of Patent: Nov. 26, 2002

(54) METHOD AND APPARATUS FOR A DISPLAY PRODUCING A FIXED SET OF IMAGES

(75) Inventors: Bryan T. Preas, Palo Alto; Helen M. Davis, Cupertino, both of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/306,752

(22) Filed: May 7, 1999

(51) Int. Cl.[7] ..... G09G 3/36

(52) U.S. Cl. ..... 345/87; 345/40; 345/107; 345/629; 345/641; 359/295; 359/296; 428/195

(58) Field of Search ..... 345/33–35, 43, 345/87, 98, 100, 103, 107, 40, 629, 641; 359/295, 296; 40/612; 428/195; 340/815.4–815.9

(56) References Cited

U.S. PATENT DOCUMENTS

| | | | | | |
|---|---|---|---|---|---|
| 3,566,391 | A | | 2/1971 | Lally | 340/336 |
| 4,126,854 | A | | 11/1978 | Sheridon | 340/373 |
| 4,443,062 | A | | 4/1984 | Togashi et al. | 350/332 |
| 4,448,490 | A | | 5/1984 | Shibuya et al. | 350/335 |
| 4,659,182 | A | * | 4/1987 | Aizawa | 349/82 |
| 4,949,081 | A | * | 8/1990 | Keller et al. | |
| 5,034,736 | A | * | 7/1991 | Bennett et al. | 345/100 |
| 5,113,272 | A | * | 5/1992 | Reamey | 349/78 |
| 5,254,981 | A | * | 10/1993 | Disanto et al. | 345/107 |
| 5,497,171 | A | * | 3/1996 | Teres et al. | 345/43 |
| 5,604,027 | A | | 2/1997 | Sheridon | 428/323 |
| 5,706,022 | A | * | 1/1998 | Hato | 345/92 |
| 5,717,514 | A | | 2/1998 | Sheridon | 359/296 |
| 5,739,801 | A | * | 4/1998 | Sheridon | 345/84 |
| 5,790,215 | A | * | 8/1998 | Sugahara et al. | 349/74 |
| 5,808,783 | A | | 9/1998 | Crowley | 359/296 |
| 5,815,306 | A | | 9/1998 | Sheridon et al. | 359/296 |
| 5,825,529 | A | | 10/1998 | Crowley | 359/296 |
| 6,038,059 | A | | 3/2000 | Silverman | 359/296 |
| 6,128,124 | A | * | 10/2000 | Silverman | 359/296 |
| 6,232,938 | B1 | * | 5/2001 | Tsuchida et al. | 345/88 |
| 6,259,421 | B1 | * | 7/2001 | Yokota et al. | 345/33 |
| 6,262,697 | B1 | * | 7/2001 | Stephenson | 345/43 |
| 6,340,965 | B1 | * | 1/2002 | Howard et al. | 345/107 |

OTHER PUBLICATIONS

U.S. patent application ser. No. 08/960,865 by Sheridon et al. titled "Twisting Cyllinder Display" filed Oct. 30, 1997.
Trayhorn et al., "The ADVISE Traffic Information Display System", Vehicle Navigation and Information Systems Conference, Sep. 11–13, 1989, Toronto Canada, Conference Record, pp. 105–112.
European Search Report for EPO Counterpart Application No. 00109540, May 4, 2000.

* cited by examiner

*Primary Examiner*—Richard Hjerpe
*Assistant Examiner*—Henry N. Tran
(74) *Attorney, Agent, or Firm*—Nola Mae McBain

(57) ABSTRACT

A method to greatly simplify and reduce the cost of displays when all of the images that need to be displayed are known beforehand. By precomputing the intersections of the images and addressing the intersections of the images, the number of drivers that are required becomes a function of the number of images rather than a function of the resolution. For example, four arbitrarily complex, overlapping images require, at most, 16 drivers. In general, n arbitrarily complex, overlapping images require, at most, $2^n$ drivers. This result holds irrespective of the size of the display or the complexity resolution, or amount of overlap of the images. Further reduction of the number of drivers is possible if some of the images do not overlap some of the other images. For example, two images overlap each other in one area and two other images may overlap each other in a separate area while the two sets of images do not themselves overlap. In this case, at most eight drivers are needed instead of the 16 drivers that would be required if all four of the images overlapped each other. In general, if you consider N separate, distinct areas, each with a set of overlapping images where $n_i$ images overlap in area i (ie, $n_1$ images that overlap in area 1, $n_2$ images that overlap in area 2, etc.). Then the maximum number of drivers that are required will be summation for i from 1 to N of 2 raised to the power of $n_i$.

24 Claims, 14 Drawing Sheets

| | C1 | C2 | C3 | C4 |
|---|---|---|---|---|
| | USED IN "HILL" IMAGE PORTION | USED IN "SLOW" IMAGE PORTION | USED IN "ICY" IMAGE PORTION | USED IN SLIPPERY CAR IMAGE PORTION |
| R1 | NO | NO | NO | NO |
| R2 | NO | NO | NO | YES |
| R3 | NO | NO | YES | NO |
| R4 | NO | NO | YES | YES |
| R5 | NO | YES | NO | NO |
| R6 | NO | YES | NO | YES |
| R7 | NO | YES | YES | NO |
| R8 | NO | YES | YES | YES |
| R9 | YES | NO | NO | NO |
| R10 | YES | NO | NO | YES |
| R11 | YES | NO | YES | NO |
| R12 | YES | NO | YES | YES |
| R13 | YES | YES | NO | NO |
| R14 | YES | YES | NO | YES |
| R15 | YES | YES | YES | NO |
| R16 | YES | YES | YES | YES |

FIG. 14

METHOD AND APPARATUS FOR A DISPLAY PRODUCING A FIXED SET OF IMAGES

INCORPORATION BY REFERENCE

The following U.S. patents are fully incorporated by reference:

U.S. Pat. No. 4,126,854 by Sheridon titled "Twisting Ball Panel Display" and issued Nov. 21, 1978, U.S. Pat. No. 5,604,027 by Sheridon titled "Some Uses Of Microencapsulation For Electric Paper" and issued Feb. 18,1997, U.S. Pat. No. 5,717,514 by Sheridon titled "Polychromal Segmented Balls For A Twisting Ball Display" and issued Feb. 10,1998, U.S. Pat. No. 5,808,783 by Sheridon titled "High Reflectance Gyricon Display" and issued Sep. 15,1998, U.S. Pat. No. 5,815,306 by Sheridon et al titled "'Eggcrate' Substrate For A Twisting Ball Display" and issued Sep. 29,1998, U.S. Pat. No. 5,825,529 by Crowley titled "Gyricon Display With No Elastomer Substrate" and issued Oct. 20, 1998, U.S. patent application Ser. No. 08/960,865 by Sheridon et al., titled "Twisting Cylinder Display" and filed Oct. 30,1997, and U.S. Pat. No. 6,088,059 by Silverman titled "Additive Color Electric Paper Without Registration Or Alignment Of Individual Elements" and filed Oct. 16, 1998.

BACKGROUND

This invention relates generally to display technologies and more particularly concerns a display which produces a specified set of images wherein each image is displayed with high resolution and can be arbitrarily complex, yet only requires a minimal number of drivers.

A wide variety of display technologies exist including LEDs, LCDs, CRT's, electrophoretic and gyricon technologies. What each of these displays has in common is that they must all be addressed. Three of the most common types of addressing schemes for displays are active matrix addressing, passive matrix address and stylus or wand addressing.

Active matrix addressing places the least demands on the properties of the display because a separate addressing electrode is provided for each pixel of the display and each of these electrodes is continuously supplied with an addressing voltage. The complete set of voltages can be changed for each addressing frame. While this type of addressing places the least demands on the properties of the display medium, active matrix addressing is the most expensive, most complicated and least energy efficient type of addressing.

Passive matrix addressing makes use of two sets of electrodes, one on each side of the display medium. Typically, one of these consists of horizontal conductive bars and the other consists of vertical conductive bars. The bars on the front surface or window of the display are necessarily transparent. To address the display medium, a voltage is placed on a horizontal conductive bar and a voltage is placed on a vertical conductive bar. The segment of medium located at the intersection of these two bars experiences a voltage equal to the sum of these two voltages. If the voltages are equal, as they usually are, the sections of medium located adjacent to the each of the bars, but not at the intersection of the bars, experience ½ the voltage experienced by the section of medium at the bar intersection. Passive addressing is less complicated and more energy efficient because the pixels of the display medium are addressed only for as long as is required to change their optical states. However, the requirements for a medium that can be addressed with a passive matrix display are significantly greater than for the active matrix case. The medium must respond fully to the full addressing voltage but it must not respond to ½ the full addressing voltage. This is called a threshold response behavior. The medium must also stay in whichever optical state it has been switched into by the addressing electrodes without the continuous application of voltage, that is it should store the image without power. Passive addressing is the most widely used method of addressing displays and is the lowest cost.

Stylus or wand addressing consists of either an addressing electrode or an array of addressing electrodes that can be moved over the surface of the display medium. Typically, the medium is placed over a grounding electrode and is protected from possible mechanical damage from the stylus or wand by placing a thin window between the stylus or wand and the display. As the stylus or wand is moved over the display medium, it applies voltages to specific pixels of the medium for short periods of time and generates a full image each time the stylus or wand is scanned over the surface. In a variation on this method, the wand may comprise a two dimensional array of electrodes that is placed in contact with the surface of the display medium.

In each of these cases, the smallest size addressing unit, called a pixel is addressed. Each pixel has the same area and shape as neighboring pixels, only its location differs from the other pixels on the display. As the pixel size decreases the resolution of the displayed image increases but so also does the complexity of the addressing device and the number of drivers needed to address the display medium, because the number of driver circuits that are required is proportional to the square of the resolution. For example, an active matrix display with a 100 pixels/inch resolution that is 10 inches by 10 inches would require 1,000,000 drivers or one driver for each pixel. The same display configured with for a passive matrix addressing system would require 2,000 drivers, or one driver for each row and one driver for each column.

As the complexity of the addressing device rises, so also does the cost. Therefore, there is always a tension between displaying the best possible image with the highest resolution and using the least complex and most cost effective means of addressing the display.

The alternative to pixel addressing has been to fabricate addressing electrodes with fixed images such as are used in pagers, watches, cellular phones and clock radios etc. This allows for good resolution of a specific limited set of images cheaply. The drawback however, is that only a single fixed image can be produced in a specific location on a display. Taking as an example, the display for a clock, portions of the display may be reserved to display the time, a pm indicator, an alarm indicator, a "snooze" indicator, and a low battery indicator. Time may be displayed using the typical 8-segment numerical display in which 8 fixed displayable segments have been chosen which can be combined to form the various numbers. Time will always be displayed in the same portion of the display, as will the other indicators that are displayed on the clock face. For instance, the low battery indicator may consist of a small icon shaped like a broken battery which blinks in one comer of the display. The low battery icon could never, for instance, alternate with the time in the same portion of the display. Therefore, the entire display consists of independent, separately addressable, non-overlapping fixed images which can either be selected or not. This reduces the complexity of the addressing device and limits the number of drivers needed to the number of images displayed.

Up to this point, the choice of addressing displays has therefore been limited to higher complexity and cost pixel addressing which allows for the unlimited choice of images which can be displayed in any region of the display, or low complexity and cost addressing which uses reserved areas to display a single fixed image. However, there exists a need for displays which are capable of showing a limited set of fixed images which are not relegated to specific portions of the display and which use a low complexity/cost addressing system.

To use the clock example again, it might be useful to have the low battery image alternate with the time in the same portion of the display to provide a more readily noticeable indication that the battery is low. Another example is a highway sign which could be used to display varying road and weather conditions such as ice, rain, snow, and fog ahead. Further examples include point of sale advertising signage which might display the various products for sale by a vendor in a freezer case.

Accordingly, it is the primary aim of the invention to provide a display capable of displaying, at high resolution, a set of known, overlapping, arbitrarily complex fixed images without requiring a correspondingly complex addressing system requiring a large number of addressing drivers.

By precomputing all of the intersections of these images, the number of drivers that are required becomes a function of the number of images rather than a function of the resolution. For example, four arbitrarily complex, overlapping images require, at most, 16 drivers. In general, n arbitrarily complex, overlapping images require, at most, $2^n$ drivers. This result holds irrespective of the size of the display, the complexity of the images, resolution, or amount of overlap of the images.

It is possible to further reduce the number of drivers if some of the images do not overlap some of the other images. For example, consider the case where two images overlap each other in one area and two other images overlap each other in a separate area. However, the two sets of images do not overlap. In this case, at most eight drivers are needed instead of the 16 drivers that would be required if all four of the images overlapped each other. In general, if you consider N separate, distinct areas, each with a set of overlapping images where $n_i$ images overlap in area i (ie, $n_1$ images that overlap in area 1, $n_2$ images that overlap in area 2, etc.). Then the maximum number of drivers that are required will be summation for I from 1 to N of 2 raised to the power of $n_i$.

This invention discloses a method to greatly simplify and reduce the cost of displays when all of the images that need to be displayed are known beforehand. Applications include (but are not limited to) road signs, informational signs, advertising, user interfaces to electronic equipment, and many other applications.

Further advantages of the invention will become apparent as the following description proceeds.

SUMMARY OF THE INVENTION

Briefly stated and in accordance with the present invention, there is provided an addressing system for producing a set of N overlapping images, each image having at least an image portion, on at least a portion of a display medium which uses no more than $2^N$ drivers in combination with a plurality of electrodes responsive to the drivers such that said plurality of electrodes can cause the display medium to display any one of the N images.

There is also provided a means of reducing the number of drivers needed to display a set of N overlapping images, each image having at least an image portion, on at least a portion of a display medium by using a plurality of electrodes, each electrode having a usage vector and electrically connecting together at least 2 electrodes having identical usage vectors.

Further, there is also provided a display for producing a set of N overlapping images, each image having at least an image portion, on at least a portion of a viewing surface of the display using a display medium, no more than $2^N$ drivers, and a plurality of electrodes responsive to said plurality of drivers such that said plurality of electrodes can cause the display medium to display any one of the N images.

There is also provided a display which uses a reduced number of drivers needed to display a set of N overlapping images on a viewing surface of a display, each image having at least an image portion, on at least a portion of a display medium by using a plurality of electrodes, each electrode having a usage vector and electrically connecting together at least 2 electrodes having identical usage vectors.

BRIEF DESCRIPTION OF THE DRAWINGS

FIG. 14 shows a table of the complete set of usage vectors for the electrodes shown in FIGS. 6–11.

While the present invention will be described in connection with a preferred embodiment and method of use, it will be understood that it is not intended to limit the invention to that embodiment or procedure. On the contrary, it is intended to cover all alterative, modifications and equivalents as may be included within the spirit and scope of the invention as defined by the appended claims.

DETAILED DESCRIPTION OF THE INVENTION

Turning now to FIGS. 1–4, there is shown a sign 10 having four different images. The size and complexity of the images is for demonstration purposes only. The images displayed can be of any arbitrary size and complexity. The images are pictured as being displayed in black and white, however, this is again for demonstration purposes only. The images could be displayed using any two colors, for example a road sign might use yellow and white, or the images could be displayed using multiple colors.

The sign 10 is a warning sign similar to the standard reflective warning signs in use today. The images shown on the sign 10 are the standard warning signs which might be found on any warning sign. In this example, the images are chosen as such to create a useful warning sign for a mountain road.

Figure 1:
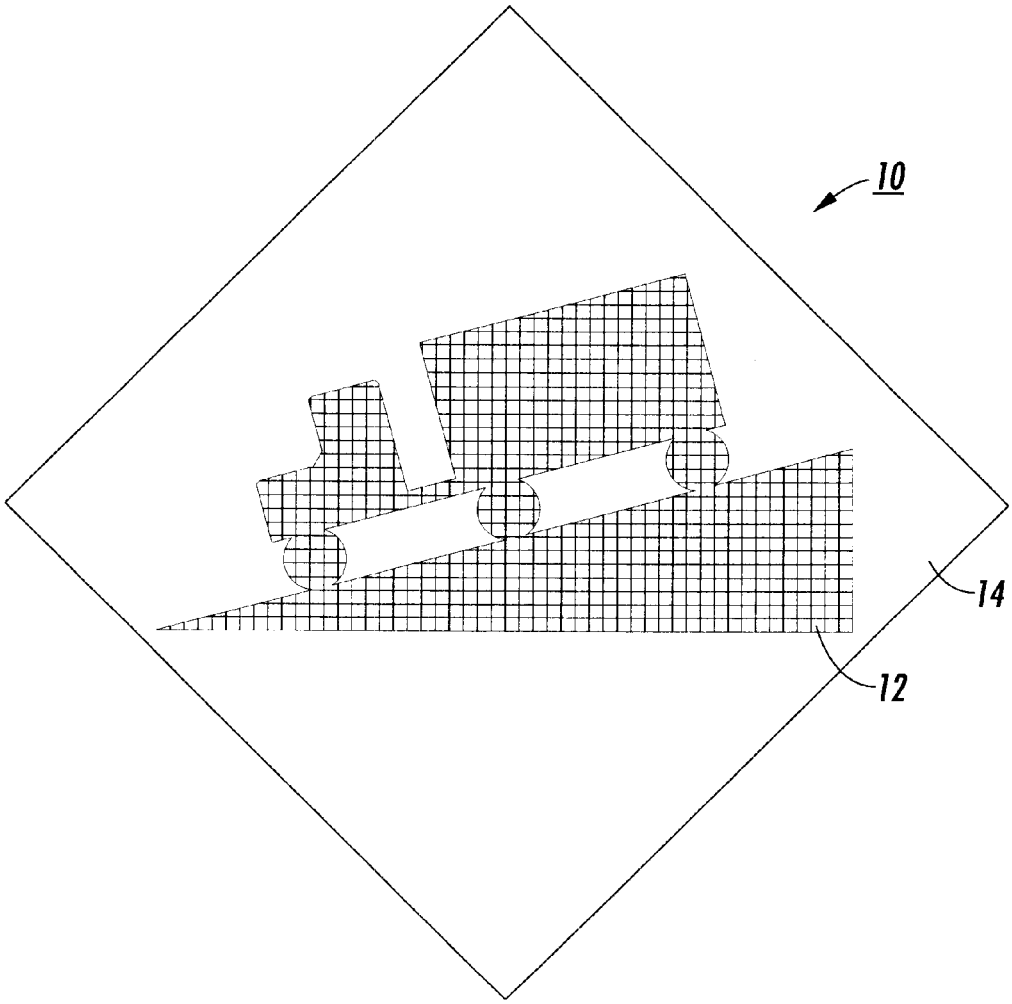
FIG. 1 shows a display with a first image displayed.
Figure 2:
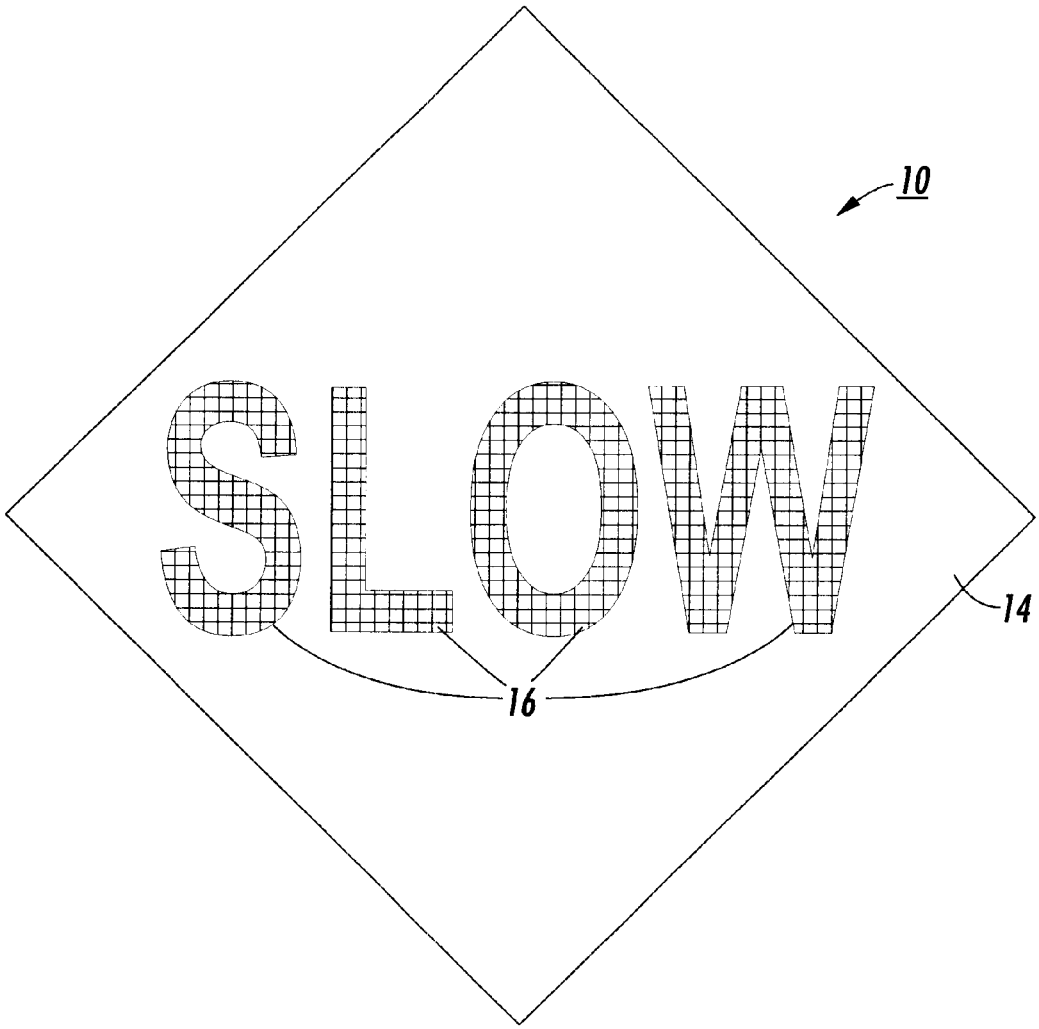
FIG. 2 shows the display of FIG. 1 with a second image displayed.
Figure 3:
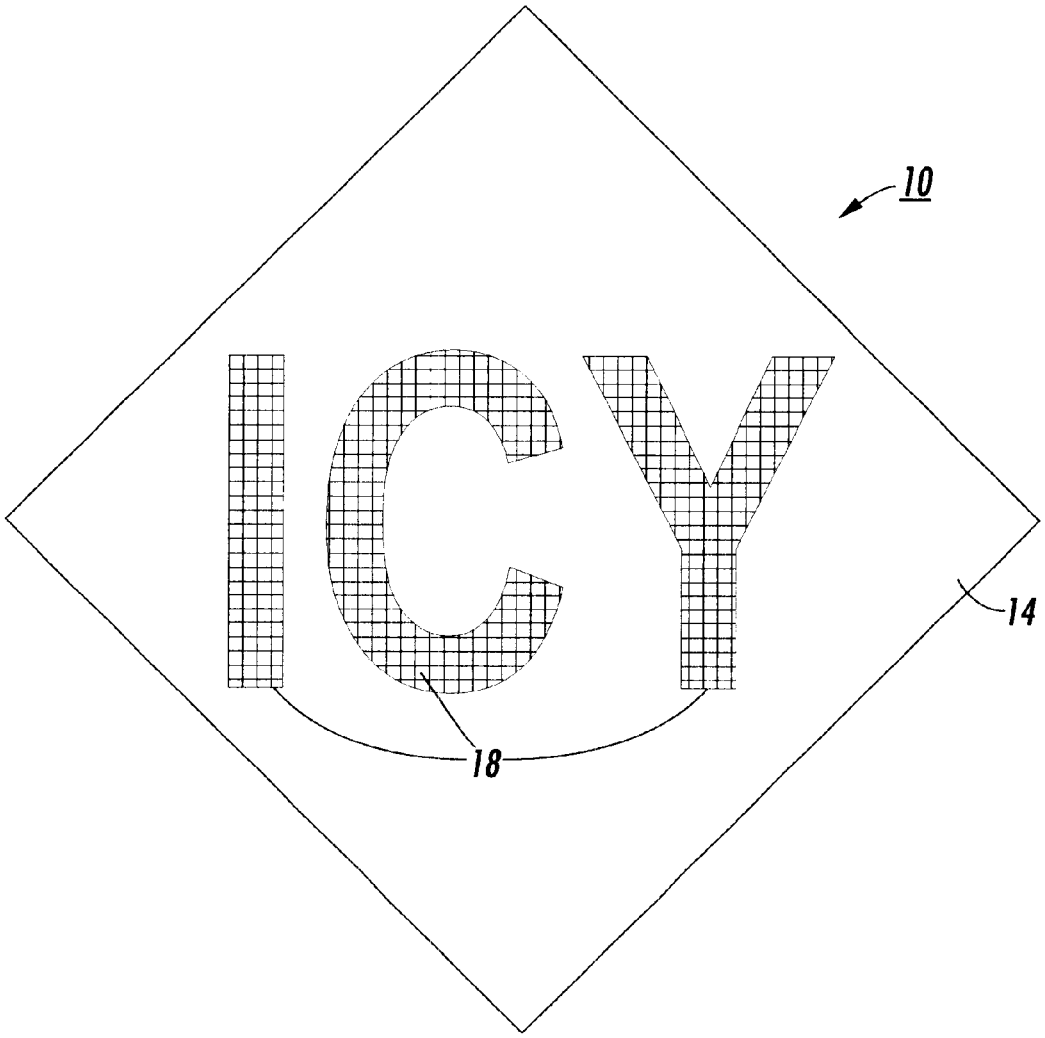
FIG. 3 shows the display of FIG. 1 with a third image displayed.
Figure 4:
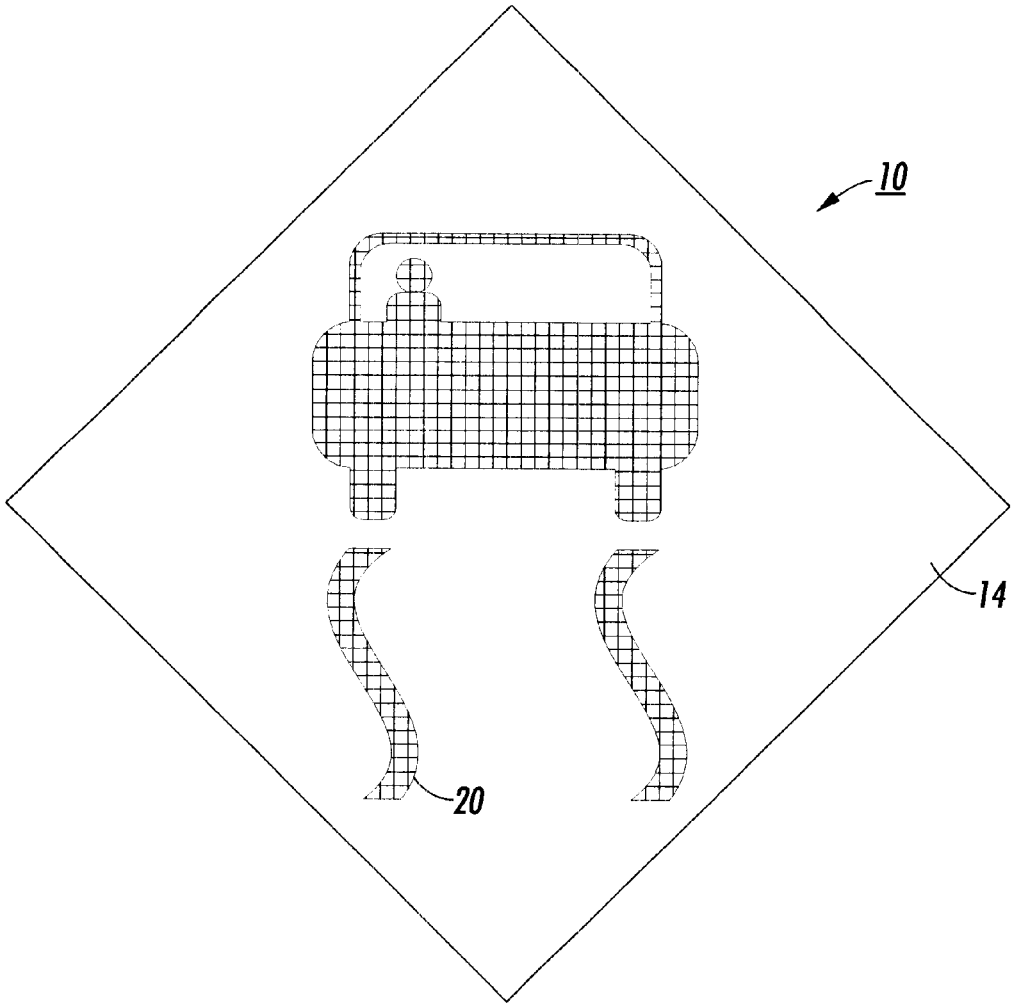
FIG. 4 shows the display of FIG. 1 with a fourth image displayed.

FIG. 1 shows a standard "hill" image 12 against a background 14. The "hill" image 12 comprises the standard warning symbol of a truck in silhouette on a triangle. FIG. 2 shows a "slow" image 16 comprising the letters "s", "I", "o", and "w" against the background 14. FIG. 3 shows an "icy" image 18 comprising the letters "i", "c", and "y" against the background 14, and FIG. 4 shows a "slippery car" image 20 against the background 14. Each of the images 12, 16, 18, and 20 shown in FIGS. 1–4 can be selected to either continuously display or to alternate with one or more of the other images. For instance, the "hill" image 12 might be the image normally displayed, however, if a temporary hazard exits on the road further down the sign 10 might then be programmed to alternate the "hill" image 12 with the "slow" image 16. On a rainy day, the sign 10 might be programmed to display the "slow" image 16 alternating with the slippery car image 20, or if the weather has dropped below freezing the sign might be programmed to alternate between all four images. Alternatively, if there is a minor road blockage the sign might be programmed to just display the "slow" image 16.

Figure 5:
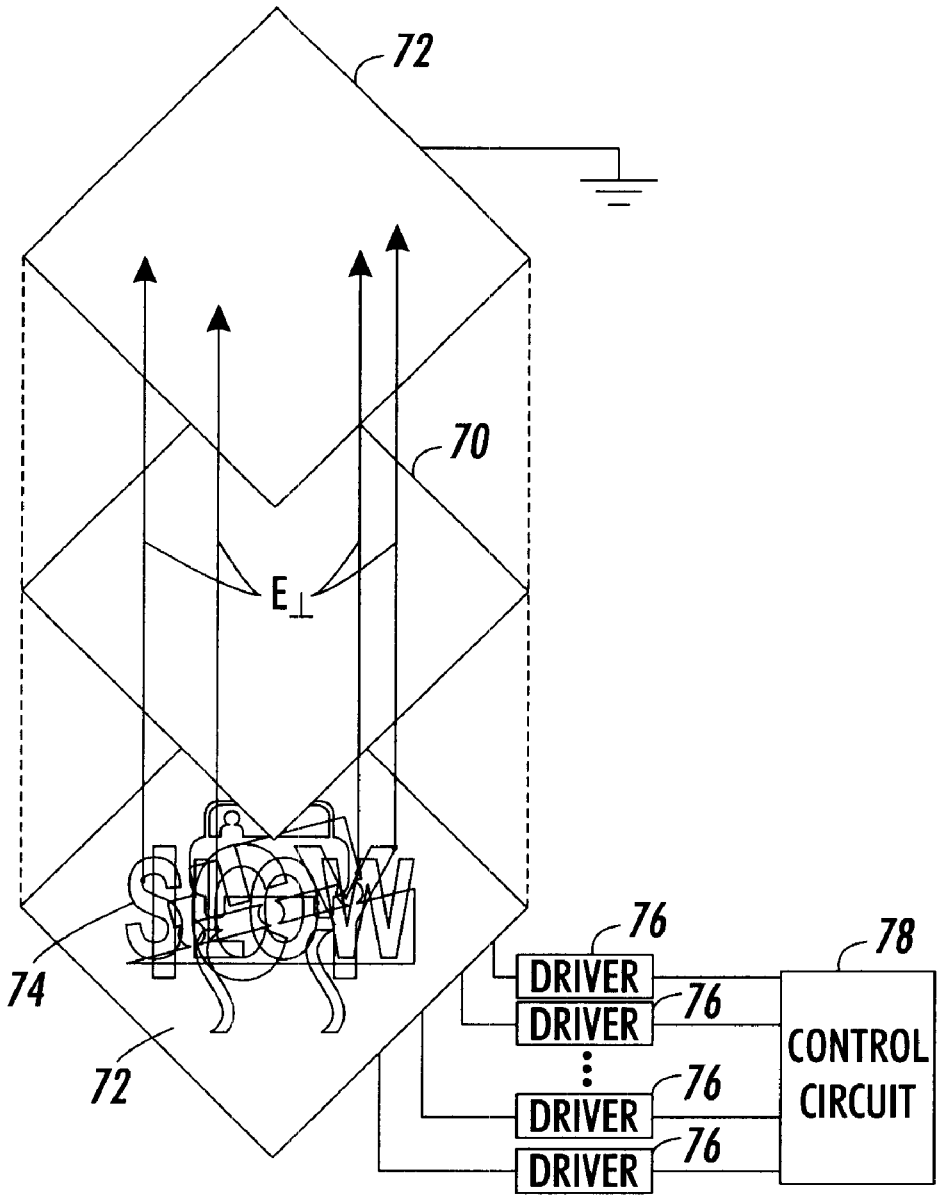
FIG. 5 shows the display of FIG. 1 and an addressing means.

To make such a display several components are needed as shown in FIG. 5. General principles of operation will be discussed with reference to FIG. 5 and a detailed specific example will be discussed hereinbelow. The first element needed is a display medium 70 which is capable of displaying at least two colors, such as black and white. Again, the colors black and white are chosen for illustrative purposes only. The display medium 70 could be a variety of materials including a liquid crystal display, an electrophoretic display or a gyricon display. A gyricon display is believed to be the most easily adapted to the current invention. Various types of gyricon display medium, their operational characteristics, and manufacture are described in U.S. Pat. No. 4,126,854 by Sheridon titled "Twisting Ball Panel Display" and issued Nov. 21, 1978, U.S. Pat. No. 5,604,027 by Sheridon titled "Some Uses Of Microencapsulation For Electric Paper" and issued Feb. 18, 1997, U.S. Pat. No. 5,717,514 by Sheridon titled "Polychromal Segmented Balls For A Twisting Ball Display" and issued Feb. 10, 1998, U.S. Pat. No. 5,808,783 by Sheridon titled "High Reflectance Gyricon Display" and issued Sep. 15, 1998, U.S. Pat. No. 5,815,306 by Sheridon et al., titled "'Eggcrate' Substrate For A Twisting Ball Display" and issued Sep. 29, 1998, U.S. Pat. No. 5,825,529 by Crowley titled "Gyricon Display With No Elastomer Substrate" and issued Oct. 20, 1998, and U.S. patent application Ser. No. 08/960,865 by Sheridon et al., titled "Twisting Cylinder Display" and filed Oct. 30, 1997, all incorporated by reference hereinabove. In summary, gyricon media is comprised of a rotatable element, rotatably disposed in a substrate having two substantially parallel surfaces. One of the surfaces is a viewing surface. The rotatable element will have at least two different visually observable characteristics. For instance, the rotatable element might comprise a sphere wherein approximately one-half of the spheres surface is colored white and the other half is colored black. However, many other variations of the rotatable elements have also been described such as elements having transparent and colored segments and elements that are cylindrically shaped.

Most often, the substrate comprises a thin sheet of elastomer into which the rotatable elements have been dispersed. The elastomer sheet is then swelled in an plasticizer which causes liquid filled cavities around the rotatable elements to form. In this form the rotatable elements are free to rotate within the substrate, but due to their inclusion within the liquid filled cavities, not free to undergo substantial translational movement within the elastomer substrate. However, other configurations have also been described such as close packed arrangements which contain rotatable elements and liquid between two solid sheets and rotatable elements which have been microencapsulated with a small volume of liquid and dispersed in a variety of solid substrate materials.

Any rotatable element can be selected and oriented by the application of an electric field across the portion of the gyricon media which contains that rotatable element. The orientation of the rotatable element will be determined by the direction of the applied electric field. In the simple case of black and white spheres an electric field may be applied substantially perpendicular to the viewing surface to cause the white surface of the sphere to be visible at the viewing surface. If the polarity of the electric field is reversed, the black surface of the sphere will be visible at the viewing surface. When the electric field is removed, the rotatable element retains its rotational alignment and continues to show whichever visual characteristic was selected by the electric field until the rotational alignment of the rotational element is changed by the application of another electric field. The selection of various areas of the gyricon media which are then driven to display a particular visual characteristic allows for the gyricon media to display images.

The display medium 70 is driven by a selection device 72. Selection device 72 has two portions, with the gyricon media interposed therebetween. One of the portions includes electrodes 74 configured into image patterns and a background pattern and connected to an array of drivers 76. The other portion is configured provide a solid ground backplane connected to ground.

The selection device 72 is used to select and drive portions of the display medium 70 to display one of the two colors as is known in the art. Electrodes can be selected and driven to desired voltages to create an electric field $E\perp$ between the two portions of the selection device 72. Adjacent electrodes can be driven to similar or different voltages such that they create electric fields $E\perp$ of similar or different polarities which are substantially perpendicular to the display medium 70. The electric fields E created between the electrodes will then cause the display medium to display different images as discussed above and as known in the art.

A set of drivers connected to the electrodes 74 on the selection device 72 are used to apply the desired voltages to the electrodes 74. Control circuit 78 is used to select which voltages the drivers 76 are to supply to the electrodes 74.

Figure 6:
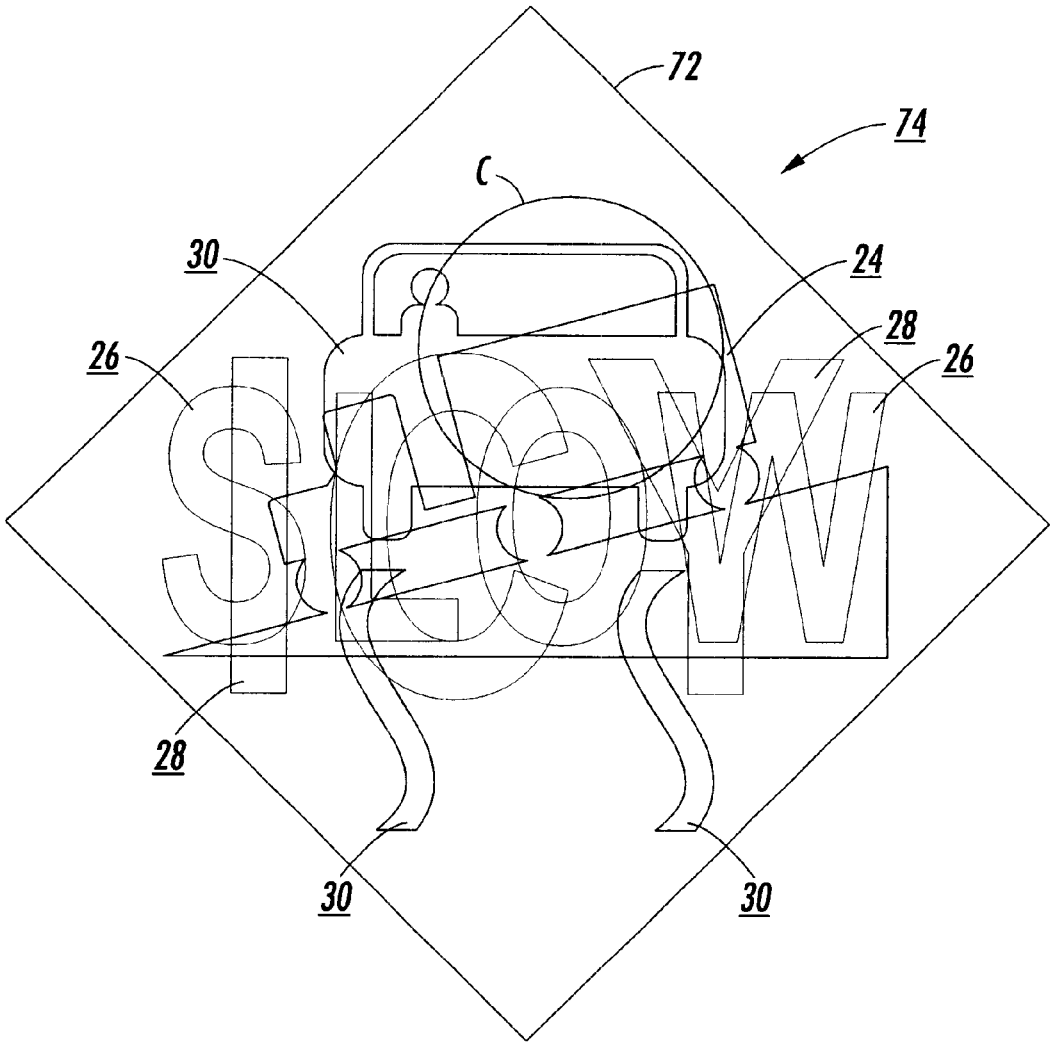
FIG. 6 shows an electrode pattern for the images shown in FIGS. 1–4 on a portion of the addressing means.

Turning now to FIG. 6, electrodes 74 on one of the portions of the selection device 72 are shown. A "hill" electrode pattern 24 corresponding to the "hill" image 12 can be seen as well as a "slow" electrode pattern 26, an "icy" electrode pattern 28, and a slippery car electrode pattern 30, the electrode patterns corresponding to the "slow" image 16, the "icy" image 18 and the slippery car image 20 respectively.

Figure 7:
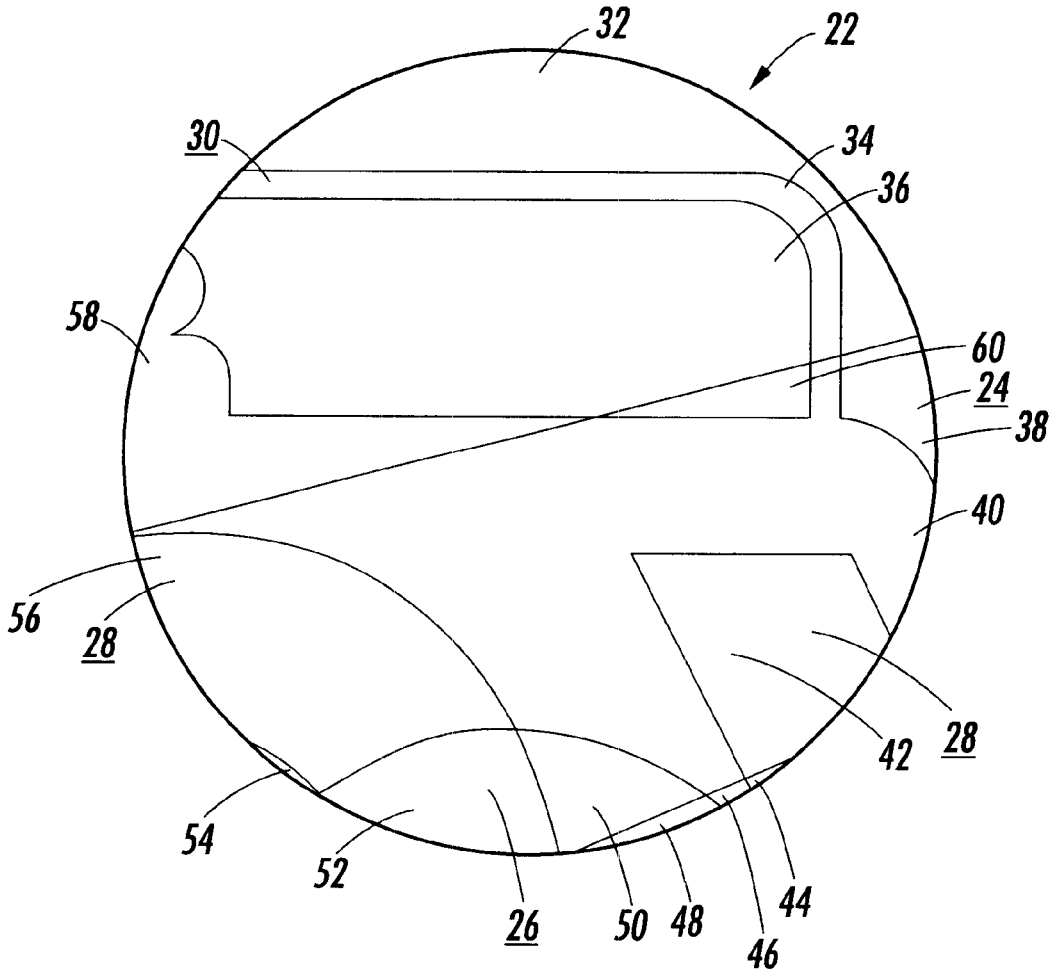
FIG. 7 shows an enlarged portion of the electrode pattern shown in FIG. 6.

FIG. 7 shows an enlarged view of the portion of the electrode patterns contained with the circle C shown in FIG. 6. In the prior art, each image would be represented by an electrode pattern consisting of two electrodes, one to select the portion of the display corresponding to the image, or an image portion, and one to select the rest of the display corresponding to the background, or a background portion. However, the images, and hence the electrodes, would not be allowed to overlap as shown in FIGS. 6 and 7. In the present invention, the electrode patterns 24, 26, 28, and 30 for each of the images overlap each other creating a complicated pattern of electrodes having various shapes. For example, the image portion of the "hill" electrode pattern 26 shown in FIG. 7 uses electrodes 38, 40, 42, 44, 46, 48, 50, 52, 54, 56, and 60 while the image portion of the "slow" electrode pattern shown in FIG. 7 only uses electrodes 48, 50, and 52. Any electrodes not used in the image portion of the electrode pattern are used in the background portion of the electrode pattern therefore, the background portion of the "hill" electrode pattern shown in FIG. 7 uses electrodes 32, 34, 36, and 58 while the background portion of the "slow" electrode pattern shown in FIG. 7 uses electrodes 32, 34, 36, 38, 40, 42, 44, 46, 54, 56, 58, and 60.

Assuming a basic configuration as shown in FIG. 5, then FIGS. 8–11 represent that portion of the display medium controlled by the electrodes shown in FIG. 7 with the electrode pattern superimposed to show how the selection of various electrodes can result in the display of the different images by the display medium 70. In this example, if an electrode is driven by a positive voltage it will cause the display medium 70 to display a "dark" color, while electrodes driven by a negative voltage will cause the display medium to display a "light" color. However, the selection of positive and negative voltages for "dark" and "light" portions respectively is arbitrary and depending on the display medium 70 used, and it's orientation to the selection device, the selection could be reversed to use positive and negative voltages to "light" and "dark" portions respectively.

Figure 8:
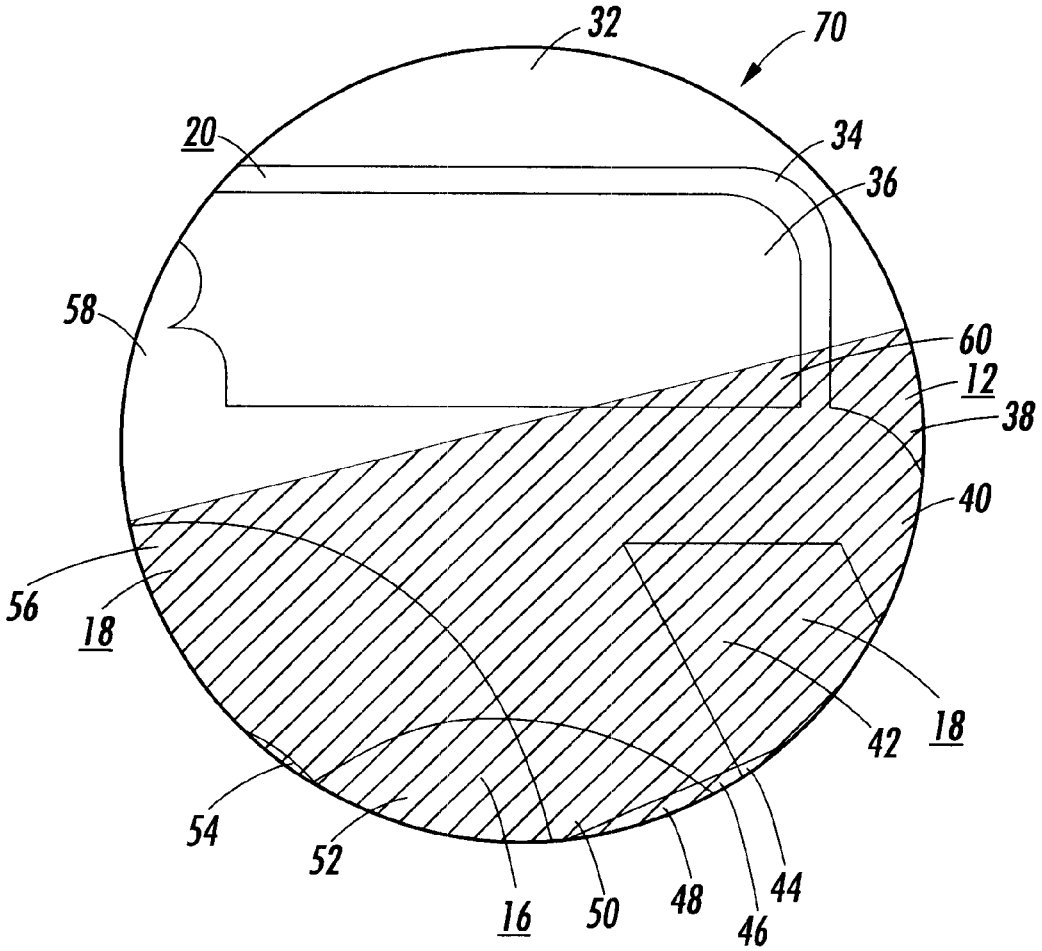
FIG. 8 shows an enlarged portion of the display shown in FIG. 1.

FIG. 8 then shows that if electrodes 38, 40, 42, 44, 46, 48, 50, 52, 54, 56, and 60, which correspond to the image portion of the "hill" electrode pattern, are driven by a positive voltage while electrodes 32, 34, 36, and 58, which correspond to the background portion of the electrode pattern, are driven by a negative voltage, then the "hill" image 12 appears as a "dark" colored image on a "light" colored background. Reversing the driving voltages, would result in reversing the image such that the "hill" image 12 would appear as a "light" colored image on a "dark" colored background (not shown).

Figure 9:
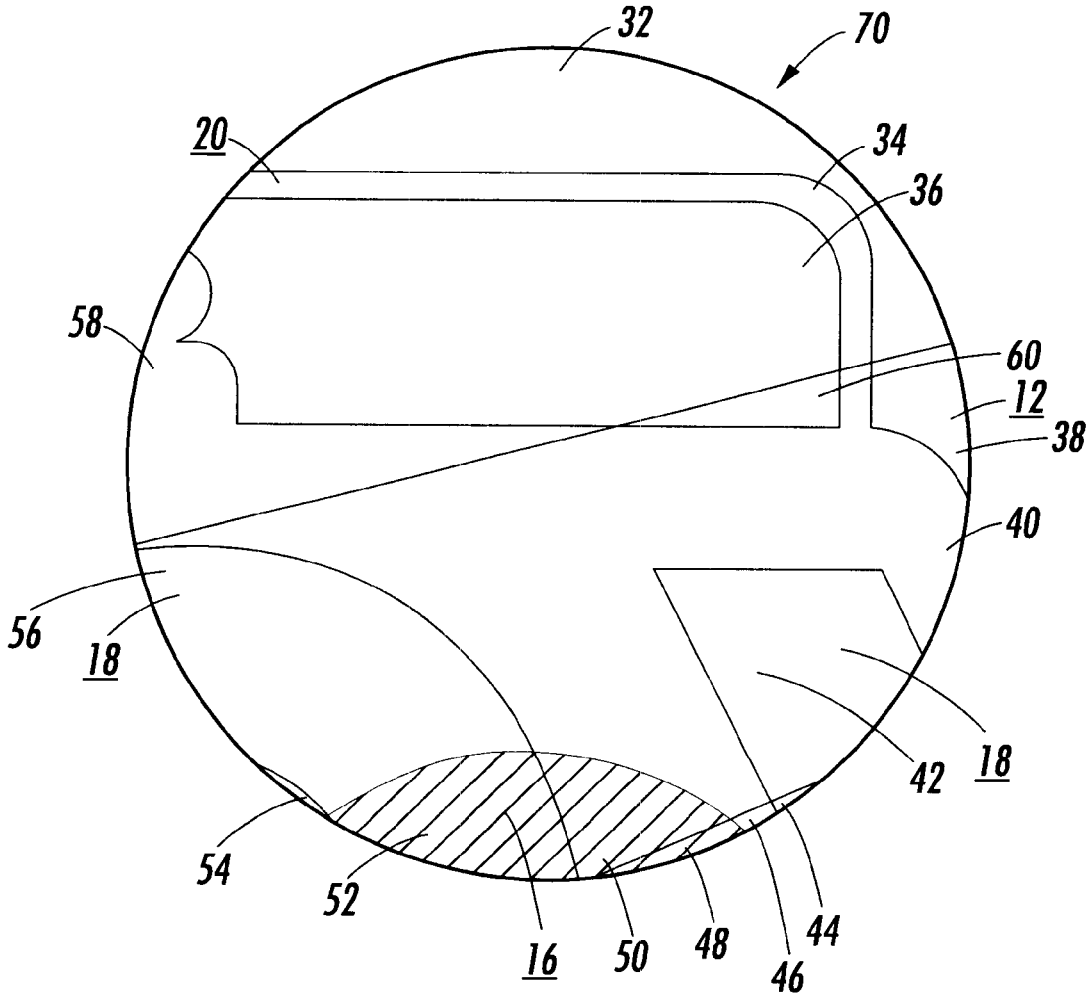
FIG. 9 shows an enlarged portion of the display shown in FIG. 2.

FIG. 9 shows that if electrodes 48, 50, and 52, which correspond to the image portion of the "slow" electrode pattern, are driven to a positive voltage while the electrodes 32, 34, 36, 38, 40, 42, 44, 46, 54, 56, 58, and 60, which correspond to the background portion of the electrode pattern, are driven to a negative voltage then the "slow" image 16 appears as a "dark" colored image on a "light" colored background.

Figure 10:
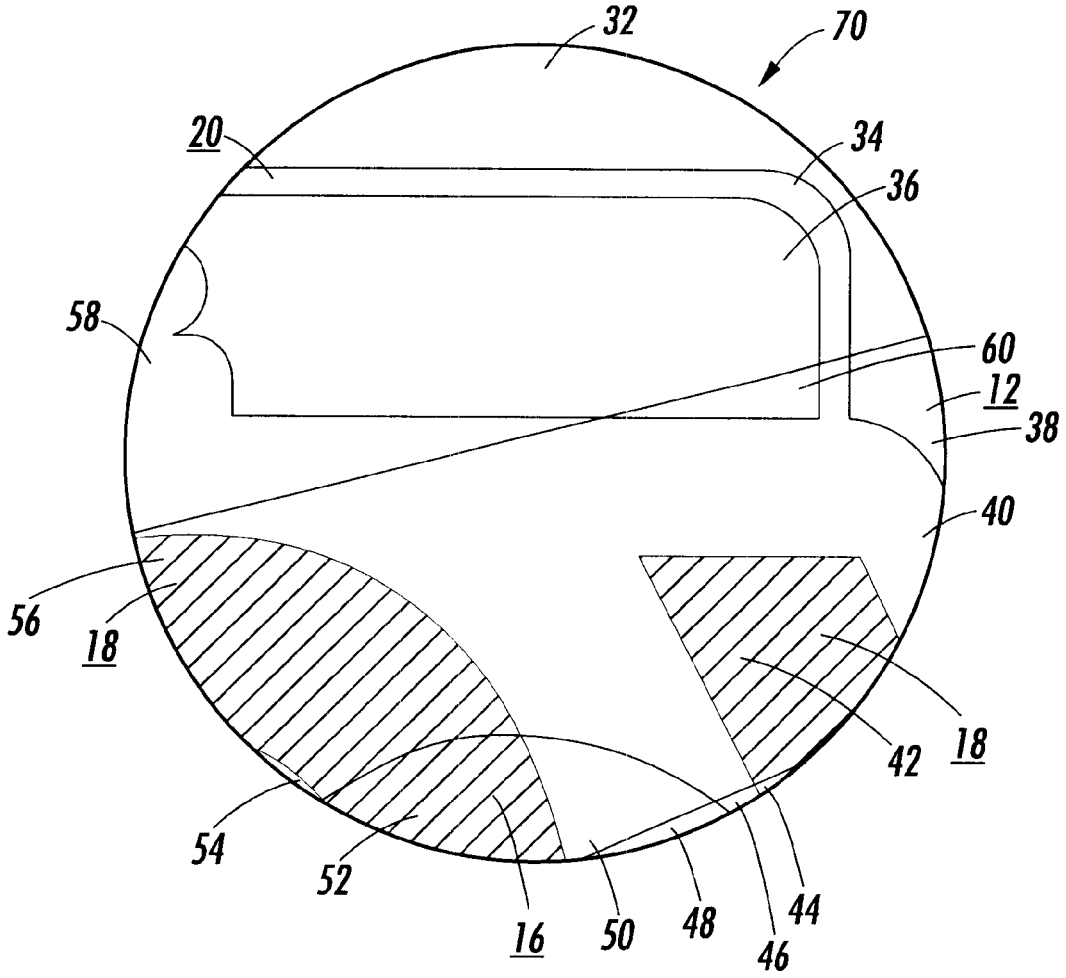
FIG. 10 shows an enlarged portion of the display shown in FIG. 3.

FIG. 10 shows that if electrodes 42, 44, 52, and 56, which correspond to the image portion of the "icy" electrode pattern, are driven to a positive voltage while the electrodes 32, 34, 36, 38, 40, 46, 48, 50, 54, 58, and 60, which correspond to the background portion of the electrode pattern, are driven to a negative voltage, then the "icy" image 18 appears as a "dark" colored image on a "light" colored background.

Figure 11:
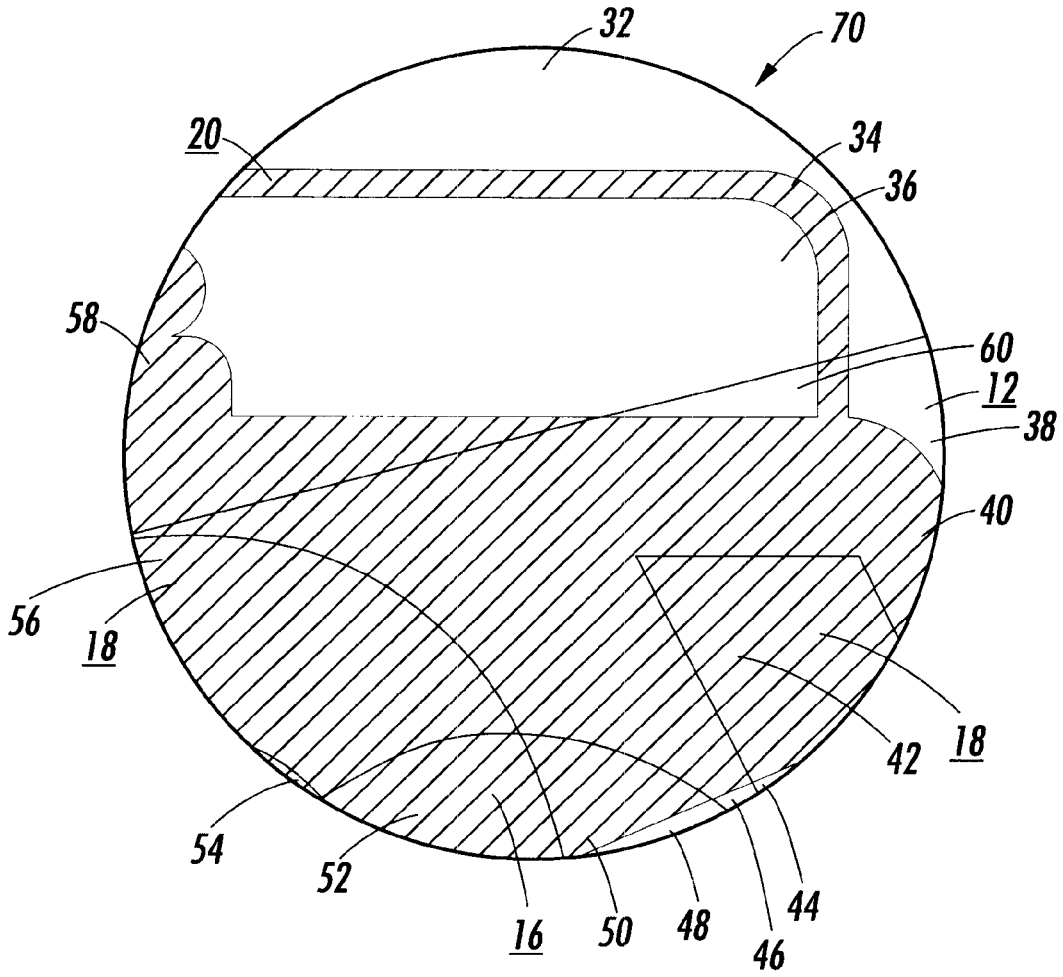
FIG. 11 shows an enlarged portion of the display shown in FIG. 4.

FIG. 11 shows that if electrodes 34, 40, 42, 44, 46, 48, 50, 52, 54, 56, and 58, which correspond to the image portion of the slippery car electrode pattern, are driven to a positive voltage while the electrodes 32, 36, 38, and 60, which correspond to the background portion of the electrode pattern, are driven to a negative voltage then the slippery car image 20 appears as a "dark" colored image on a "light" colored background.

As FIGS. 8–11 illustrate, some electrodes, such as electrodes 32 and 36 may only be used to display a background, some electrodes, such as electrodes 34 or 60, may be used as an image portion electrode for one image while being used as a background portion for the rest of the images; some electrodes, such as electrode 40, may be used as an image portion electrode for two images while being used as a background portion electrode for the rest of the images, some electrodes, such as electrodes 42, 50 or 56, may be used as an image portion electrode for three images while being used as a background portion electrode for only 1 image, and some electrodes, such as electrode 52, may be used as an image portion electrode for all the images.

For a selection of 4 images, such as have been illustrated herein, there are 16 possible combinations of how a given electrode can be used which are shown as the 16 rows R1–R16 of the table shown in FIG. 14. Each of the possible combinations, or rows R1–R16, is called a usage vector. This table lists the four image portions in the columns C1–C4 and whether an electrode is used in that image portion for all 16 possible combinations or usage vectors shown in rows R1–R16. To display any image, all electrodes must be used, either in the image portion or the background portion, therefore if an electrode is not used in the image portion of a particular image it must be used in the background portion of that image. As shown in the examples described hereinabove, if an electrode is used in an image portion then it is driven to a positive voltage. If an electrode is not used in an image portion, it must be used in a background portion and it is driven to a negative voltage.

The table in FIG. 14 is an exhaustive list of all possible usage vectors, therefore, every electrode must be describable in terms of its usage or have a usage vector selected from one of the rows R1–R16 of the table shown in FIG. 14. If each of the electrodes falling into the same combination or having the same usage vector, that is all electrodes whose usage is described by a single row in the table, are electrically connected together, then only 16 drivers are needed to supply the correct voltages to the electrodes to enable the display medium 70 to display any one of the four images.

This concept can be generalized to describe a set of N images. For any collection of N images, then a maximum number of $2^N$ usage vectors exist and a maximum number of $2^N$ drivers are needed to enable the display medium 70 to display the N images.

Returning to FIGS. 8–11, this can be illustrated by noting that electrode 32 and 36 are never used in the image portion for any of the images, and therefore are always used in the background portion (as represented by the usage vector shown in row R1 of the table in FIG. 14), and hence can be connected together electrically and driven by one common driver. Electrodes 34 and 58 are only used in the image portion for the slippery car image and are used in the background portions of the rest of the images (as represented by the usage vector shown in row R2 of the table in FIG. 14), and hence can be connected together electrically and driven by one common driver. Electrodes 48 and 50 are used in the image portion of the "hill" image, the "slow" image, and the "slippery car" image but are used in the background portion of the "icy" image (as represented by the usage vector shown R14 of the table in FIG. 14), and hence can be connected together electrically and driven by one common driver.

While it is likely that any collection of images may use all the usage vectors described above, it is possible to construct images which only use a subset of the image vectors as shown in the example discussed with respect to FIGS. 7–11. This provides a further reduction in the number of drivers needed as drivers are only needed for the usage vectors actually used.

To implement the electrodes 74 of selection device 72 a set of images 12, 16, 18, 20, such as those shown in FIGS. 1–4 is first selected. Then the electrodes 74, such as shown in FIG. 6, are then determined from the images. Analysis of the electrodes 74, such as done hereinabove with respect to FIG. 7 and the table above, is then performed to determine which individual electrodes have common usage vectors and hence are to be electrically connected together and driven by each of the common drivers. The electrodes 74 can then be fabricated on a 2 layer printed circuit board using conductive areas on a surface of the printed circuit board for the electrodes and vias with interconnects on the other layer of board to interconnect the individual electrodes as is known in the art. If the electrodes 74 are numerous and the interconnections between them especially complex, a multiple layer circuit board having more than two layers may be used to simplify the interconnections. The ground plane which comprises the other portion of the selection device 72 can be implemented as a substantially transparent conductive layer, such as an ITO layer as known in the art, which is deposited directly on the viewing surface of the display medium and supplied with a ground connection.

The array of drivers 76 and the control circuit 78 may be attached directly to the same printed circuit board as used to fabricate the electrodes 74 or may be fabricated on a separate driver board and connected to the electrodes 74 using printed circuit board technology and interconnects as known in the art. The control circuit 78 may be implemented in various ways using a programmed microprocessor, a look-up table in ROM, or using a logic array. Essentially, the control circuit 78 consists of an electrical implementation, such as known in the art, of a table constructed such as the one hereinabove. Each usage vector in the table corresponds to a separate driver. Each drivers is driven according to the table, such that when an image is selected to be displayed the driver provides a positive voltage if driving an image portion for selected image and provides a negative voltage if driving a background portion for the selected image.

Figure 12:
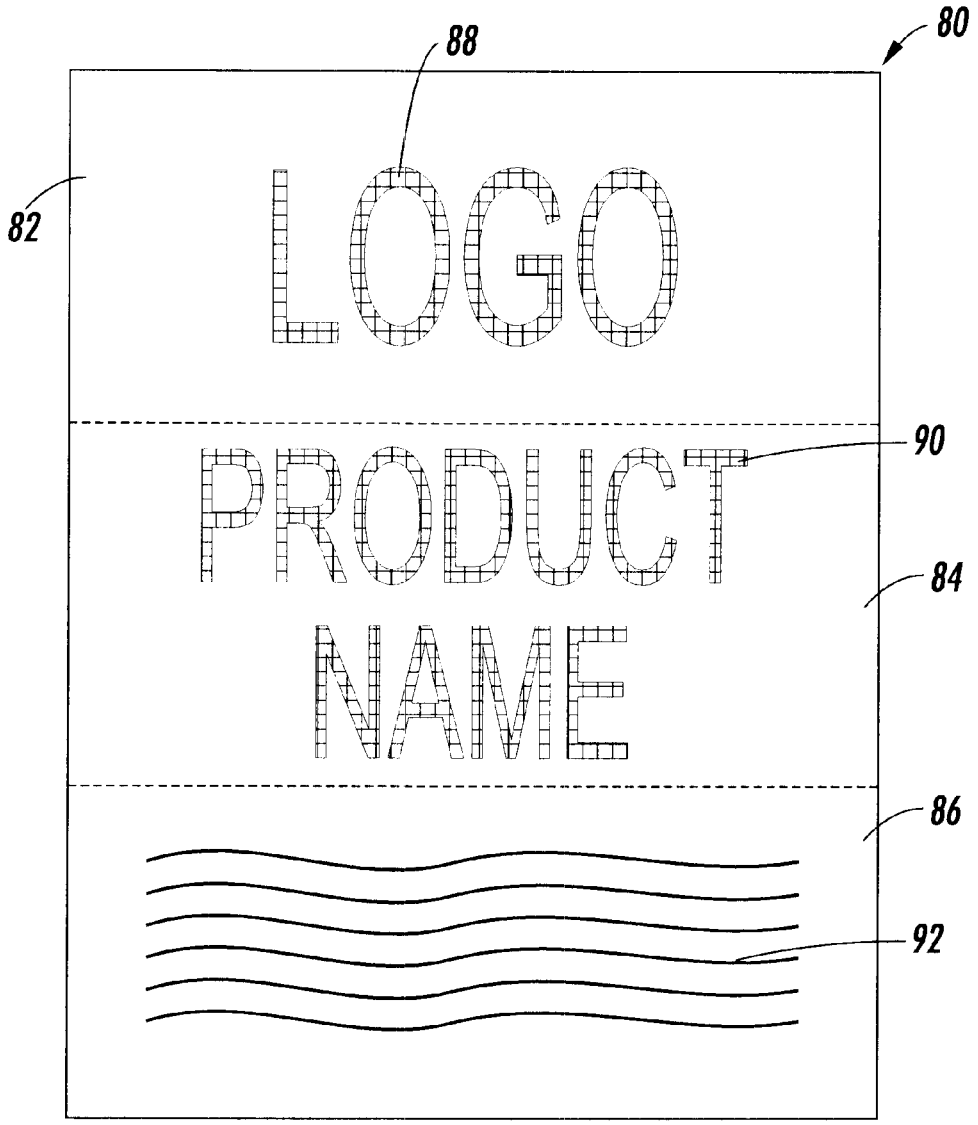
FIG. 12 shows a display which has been divided into portions with each portion having a separate addressing means.

It should be noted that while the above description focuses on a display with a single set of overlapping images, the present invention can be expanded to include a display 80 which is divided in portions 82, 84, 86, where each portion may contain a set of images as shown in FIG. 12. For instance, for point of sale signage, it may be desired to have a portion 82 which contains a logo 88, a portion 84 containing a product name 90, and a portion 86 which contains some lines of text 92. Each portion 82, 84, 86 would have a separate addressing device. All portions 82, 84, 86 need not be addressed with an addressing device according to the present invention, but some portions may, if desired, by addressed by other types of addressing devices. For example, portion 86 may be addressed by a pixel level type of addressing device if it is desired for the text 92 to scroll upwards through portion 86.

Furthermore, if each of the portions only contain a limited number of known, fixed overlapping images that do not extend into the other portions, then the number of electrodes can be reduced further. For example, suppose in FIG. 12 two logos 88 overlap each other in portion 82 and two product names 90 overlap each other in portion 84 while the logos 88 and product names 90 do not themselves overlap. In this case, at most eight drivers are needed instead of the 16 drivers that would be required if all four of the images overlapped each other. In general, if you consider N separate, distinct areas, each with a set of overlapping images where $n_i$ images overlap in area i (ie, $n_1$ images that overlap in area 1, $n_2$ images that overlap in area 2, etc.). Then the maximum number of drivers that are required will be summation for i from 1 to N of 2 raised to the power of $n_i$.

Further extensions of the present invention apply to gyricon sheets configured for enhanced grey scale, highlight color, and full color. Enhanced grey scale and color versions of gyricon media have been described in U.S. Pat. No. 5,717,514 by Sheridon titled "Polychromal Segmented Balls For A Twisting Ball Display" and issued Feb. 10, 1998, U.S. patent application Ser. No. 08/960,865 by Sheridon et al., titled "Twisting Cylinder Display" and filed Oct. 30, 1997, and U.S. patent application Ser. No. 09/173,906 by Silverman titled "Additive Color Electric Paper Without Registration Or Alignment Of Individual Elements" and filed Oct. 16, 1998 all incorporated by reference hereinabove. Several types of greyscale and color electric paper are described which can be addressed by a multipass/multithresholding addressing technique detailed in U.S. Pat. No. 5,717,514 by Sheridon titled "Polychromal Segmented Balls For A Twisting Ball Display" and issued Feb. 10, 1998 all incorporated by reference hereinabove.

Enhanced grey scale, highlight color and color gyricon media contain at least two different populations of rotatable elements which have different rotational thresholds. For enhanced grey scale the different populations may be colored as normally or may instead be divided into two sets of elements where the first set displays black and white and the second set displays two intermediate values of grey. Highlight color can be obtained by having a second population that may display black or white and a third color. Alternatively, color gyricon media sometimes contains at least one population of rotatable elements which are configured to have two relatively large transparent end slices and at least one thin opaque center slice. These rotatable elements can be oriented such that the opaque center slice is oriented to present a face to the viewing surface, thereby making the color on the opaque center slice visible, or to present only the edge of the opaque center slice, thereby being substantially transparent. In some cases, the gyricon media sheet may have an opaque backing sheet applied to the surface opposite the viewing surface to improve the background color or provide an additional color. However, these listed configurations are merely examples of some of the different known gyricon sheet configurations which have been described in the references incorporated hereinabove and are meant to provide some examples of different useful material configurations, not to limit the application of the invention described herein.

Multipass/Multithresholding addressing, as described in U.S. Pat. No. 5,717,514 by Sheridon titled "Polychromal Segmented Balls For A Twisting Ball Display" and issued Feb. 10, 1998 and incorporated by reference hereinabove, refers to providing individual electrodes with voltages of different levels to create electric fields of different levels. If the different populations of rotatable elements are made to respond to different electric field levels, then multipass/multithreshold addressing will allow for the selective orientation of the different populations of rotatable elements. The multipass/multithreshold addressing technique as detailed in U.S. Pat. No. 5,717,514 by Sheridon titled "Polychromal Segmented Balls For A Twisting Ball Display" and issued Feb. 10, 1998, can be summarized as follows.

First assume N different populations of rotatable elements, wherein each population has a unique threshold value called $v_i$ for rotation of that population where $v_i$ is the threshold value for the ith population for every integer between 1 and N. Further assumed that $v_1$ is the lowest threshold value and each subsequent population has a higher value up to $v_N$ having the highest threshold value. Therefore, when $v_N$ is supplied all the rotational elements in all populations rotate but when $v_1$ is supplied only those rotational elements in the $1^{st}$ population rotate and when intermediate values are supplied then only those rotational elements whose populations have a threshold value that is equal to or less than the intermediate value will rotate, ie: supplying $v_i$ rotates the $1^{st}$ through $i^{th}$ populations but not the $(i+1)^{th}$ through $N^{th}$ populations. The N populations can be addressed using multiple passes in a descending order starting with addressing the $N^{th}$ population by supplying $v_n$ in the first pass. When $v_n$ is supplied, not only will it rotate the rotational elements of the $N^{th}$ population, but it will also rotate the elements of all the other populations. In the second pass the $(N-1)^{th}$ population can then be addressed by supplying $v_{n-1}$ which will also rotate the $1^{st}$ through $(N-2)^{th}$ populations but not rotate the $N^{th}$ population. This process continues through successive passes, finally in the $N^{th}$ pass addressing the $1^{st}$ population only by supplying $v_1$. The multipass/multithresholding addressing will always at most take N passes for N populations, however, depending on the specific orientation desired of the different populations may use fewer than N passes.

Figure 13:
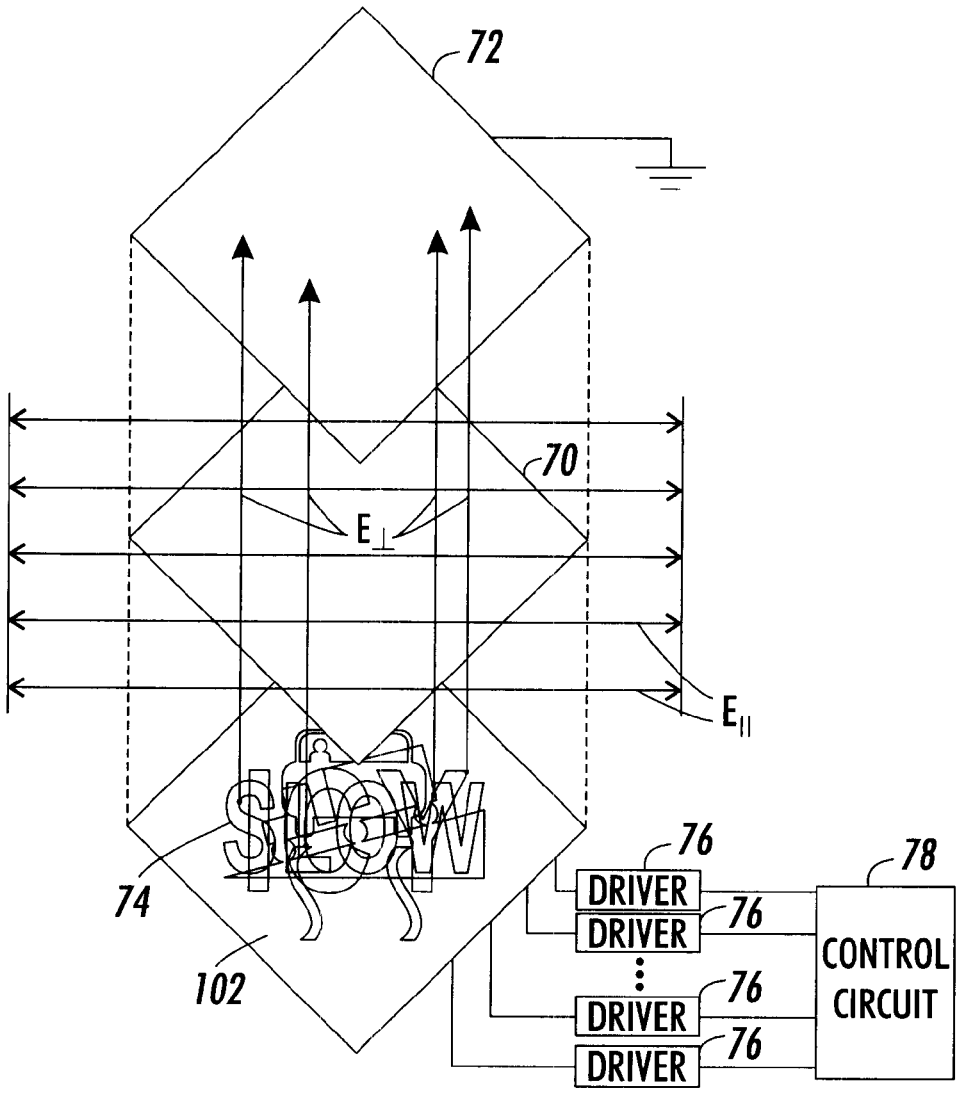
FIG. 13 shows the display of FIG. 1 with an alternative addressing means.

The multipass/multithreshold addressing technique can be used with the system shown in FIG. 5 provided that the drivers 76 are configured to produce the multiple voltages needed to provide the multithreshold addressing. However, some of the gyricon display mediums that have been described for use with multipass/multithreshold addressing also require a 90 degree rotation in addition to the 180 degree rotation. Specifically, gyricon display mediums utilizing rotatable elements configured to have two relatively large transparent end slices and at least one thin opaque center slice as discussed above. These types of gyricon display media can be addressed by a slight modification of the addressing system as shown in FIG. 13 to include providing an electric field $E_{||}$ parallel to the display medium 100 in the selection device 72. Again, if multipass/multithreshold addressing is used then the electric field $E_{||}$ parallel to the display medium 100 must be configured to produce the multiple field levels needed to provide the multithreshold addressing.

What is claimed is:

1. An addressing system for producing a set of N overlapping images, each image having at least an image portion, on at least a portion of a display medium comprising:

a) a plurality of drivers numbering no more than $2^N$ drivers, and b) at least $2^N+1$ electrodes responsive to said plurality of drivers such that said plurality of electrodes can cause the display medium to display any one of the N images.

2. The addressing system of claim 1 further comprising control circuitry for selecting which on of the N images is to be displayed, said plurality of drivers being responsive to said control circuitry.

3. The addressing system of claim 1 further comprising a ground electrode.

4. An addressing system for producing a set of N overlapping images, each image having at least an image portion, on at least a portion of a display medium comprising a plurality of electrodes, each electrode having a usage vector, wherein at least 2 electrodes having identical usage vectors are electrically connected together.

5. The addressing system of claim 4 wherein the usage vector comprises a description of the usage of the electrode.

6. The addressing system of claim 5 wherein the description of the usage of the electrode comprises the information of whether or not the electrode is used in the image portion of each of the N images.

7. The addressing system of claim 4 further comprising a plurality of drivers, said plurality of electrodes being responsive to said plurality of drivers such that said plurality of electrodes can cause the display medium to display any one of the N images.

8. The addressing system of claim 7 further comprising control circuitry for selecting which one of the N images is to be displayed, said plurality of drivers being responsive to said control circuitry.

9. The addressing system of claim 4 further comprising a ground electrode.

10. A display for producing a set of N overlapping images, each image having at least an image portion, on at least a portion of a viewing surface of the display comprising:

a) a plurality of drivers numbering no more than $2^N$ drivers, b) a plurality of at least $2^N+1$ electrodes responsive to said plurality of drivers, and c) a display medium responsive to said plurality of electrodes such that said plurality of electrodes can cause said display medium to display any one of said N images on the display surface.

11. The display of claim 10 further comprising control circuitry for selecting which one of the N images is to be displayed, said plurality of drivers being responsive to said control circuitry.

12. The display of claim 10 further comprising a ground electrode.

13. The display of claim 10 wherein the display medium comprises a liquid crystal display.

14. The display of claim 10 wherein the display medium comprises an electrophoretic display.

15. The display of claim 10 wherein the display medium comprises a rotating element display.

16. An display for producing a set of N overlapping images, each image having at least an image portion, on at least a portion of a viewing surface of the display comprising a plurality of electrodes, each electrode having a usage vector, wherein at least 2 electrodes having identical usage vectors are electrically connected together and display medium responsive to said plurality of electrodes.

17. The display of claim 16 wherein the usage vector comprises a description of the usage of the electrode.

18. The display of claim 17 wherein the description of the usage of the electrode comprises the information of whether or not the electrode is used in the image portion of each of the N images.

19. The display of claim 17 further comprising a plurality of drivers, said plurality of electrodes being responsive to said plurality of drivers such that said plurality of electrodes can cause the display medium to display any one of the N images.

20. The display of claim 19 further comprising control circuitry for selecting which one of the N images is to be displayed, said plurality of drivers being responsive to said control circuitry.

21. The display of claim 16 further comprising a ground electrode.

22. The display of claim 16 wherein the display medium comprises a liquid crystal display.

23. The display of claim 16 wherein the display medium comprises an electrophoretic display.

24. The display of claim 16 wherein the display medium comprises a rotating element display.

* * * * *